US009862187B1

(12) United States Patent
Mu et al.

(10) Patent No.: US 9,862,187 B1
(45) Date of Patent: Jan. 9, 2018

(54) INKJET PRINTHEAD TEMPERATURE SENSING AT MULTIPLE LOCATIONS

(71) Applicant: RF Printing Technologies LLC, Pittsford, NY (US)

(72) Inventors: Richard Mu, Irvine, CA (US); Yonglin Xie, Pittsford, NY (US)

(73) Assignee: RF Printing Technologies LLC, Pittsford, NY (US)

( * ) Notice: Subject to any disclaimer, the term of this patent is extended or adjusted under 35 U.S.C. 154(b) by 0 days.

(21) Appl. No.: 15/242,627

(22) Filed: Aug. 22, 2016

(51) Int. Cl.
*B41J 2/045* (2006.01)
*B41J 2/365* (2006.01)

(52) U.S. Cl.
CPC ..... *B41J 2/04588* (2013.01); *B41J 2/0454* (2013.01); *B41J 2/0458* (2013.01); *B41J 2/0459* (2013.01); *B41J 2/04501* (2013.01); *B41J 2/04563* (2013.01); *B41J 2/04591* (2013.01); *B41J 2/365* (2013.01)

(58) Field of Classification Search
CPC ..... B41J 2/04588; B41J 2/365; B41J 2/0458; B41J 2/0454; B41J 2/04563; B41J 2/04501; B41J 2/0459; B41J 2/04591
See application file for complete search history.

(56) References Cited

U.S. PATENT DOCUMENTS 4,791,435 A 12/1988 Smith et al.
4,910,528 A 3/1990 Firl et al.
4,971,435 A 11/1990 Shaw et al.
4,982,199 A 1/1991 Dunn
5,036,377 A 7/1991 Pathak et al.
5,075,690 A 12/1991 Kneezel
5,388,134 A 2/1995 Douglass et al.
5,467,113 A 11/1995 Ishinaga et al.
5,745,130 A 4/1998 Becerra et al.
5,881,451 A 3/1999 Kneezel et al.
5,917,509 A 6/1999 Becerra et al.
6,037,831 A 3/2000 Watrobski et al.
6,068,363 A * 5/2000 Saito ..... B41J 2/04541 347/17
6,278,468 B1 8/2001 Watrobski et al.
6,293,655 B1 * 9/2001 Imanaka ..... B41J 2/04528 347/58
6,302,507 B1 10/2001 Prakash et al.
(Continued)

FOREIGN PATENT DOCUMENTS

EP 0 622 209 8/1999

*Primary Examiner* — Julian Huffman
(74) *Attorney, Agent, or Firm* — Gary A. Kneezel

(57) ABSTRACT

An inkjet printing system includes at least one drop ejector array module having an array of drop ejectors disposed on a substrate. A primary temperature sensor is located near a first set of drop ejectors. At least one secondary temperature sensor is located near a second set of drop ejectors. Temperature comparison circuitry on the substrate is configured to compare signals from the primary temperature sensor and the at least one secondary temperature sensor. Pulse modification circuitry on the substrate is electrically connected to the temperature comparison circuitry and is configured to modify an input pulse waveform. The inkjet printing system also includes a controller that is electrically connected to the primary temperature sensor via a temperature output pad and to the pulse modification circuitry via a pulse waveform input pad.

20 Claims, 8 Drawing Sheets

(56) References Cited

U.S. PATENT DOCUMENTS

| | | | | |
|---|---|---|---|---|
| 6,322,189 | B1 | 11/2001 | Anderson et al. | |
| 7,163,278 | B2 | 1/2007 | Lee et al. | |
| 7,310,106 | B2 * | 12/2007 | Cui | B41J 2/36 347/188 |
| 7,572,051 | B2 | 8/2009 | Limb et al. | |
| 8,419,158 | B2 | 4/2013 | Jeong et al. | |
| 9,415,588 | B1 * | 8/2016 | Azuma | B41J 2/04563 |
| 2008/0062216 | A1 * | 3/2008 | Bergstedt | B41J 2/04563 347/17 |
| 2010/0134554 | A1 * | 6/2010 | Sheahan | B41J 2/0451 347/17 |
| 2011/0261104 | A1 * | 10/2011 | Tatsumi | B41J 2/04528 347/17 |
| 2013/0093809 | A1 * | 4/2013 | Kosaka | B41J 2/04528 347/10 |
| 2013/0176357 | A1 * | 7/2013 | Yasutani | B41J 2/0454 347/17 |
| 2015/0062251 | A1 * | 3/2015 | Goden | B41J 2/14072 347/58 |
| 2015/0343817 | A1 * | 12/2015 | Yokozawa | B41J 2/0454 347/17 |

* cited by examiner

FIG. 1 – PRIOR ART

FIG. 2 – PRIOR ART

PRIOR ART

A
211
212
213
210
201
$t_1$
$W_p$
$W_f$
T = $T_1$ 221
222
223
220
202
T = $T_2$ > $T_1$ 231
232
233
230
203
T = $T_3$ > $T_2$ 241
242
243
240
204
T = $T_4$ > $T_3$ 251
252
250
205
T = $T_5$ > $T_4$ 261
260
206
T = $T_6$ > $T_5$

INKJET PRINTHEAD TEMPERATURE SENSING AT MULTIPLE LOCATIONS

FIELD OF THE INVENTION

This invention pertains to the field of inkjet printing and more particularly to temperature sensing at different locations on a drop ejector array module and providing drop volume control for the different locations.

BACKGROUND OF THE INVENTION

Inkjet printing is typically done by either drop-on-demand or continuous inkjet printing. In drop-on-demand inkjet printing ink drops are ejected onto a recording medium using a drop ejector including a pressurization actuator (thermal or piezoelectric, for example). Selective activation of the actuator causes the formation and ejection of a flying ink drop that crosses the space between the printhead and the recording medium and strikes the recording medium. The formation of printed images is achieved by controlling the individual formation of ink drops, as is required to create the desired image.

Motion of the recording medium relative to the printhead during drop ejection can consist of keeping the printhead stationary and advancing the recording medium past the printhead while the drops are ejected, or alternatively keeping the recording medium stationary and moving the printhead. This former architecture is appropriate if the drop ejector array on the printhead can address the entire region of interest across the width of the recording medium. Such printheads are sometimes called pagewidth printheads. A second type of printer architecture is the carriage printer, where the printhead drop ejector array is somewhat smaller than the extent of the region of interest for printing on the recording medium and the printhead is mounted on a carriage. In a carriage printer, the recording medium is advanced a given distance along a medium advance direction and then stopped. While the recording medium is stopped, the printhead carriage is moved in a carriage scan direction that is substantially perpendicular to the medium advance direction as the drops are ejected from the nozzles. After the carriage-mounted printhead has printed a swath of the image while traversing the print medium, the recording medium is advanced; the carriage direction of motion is reversed; and the image is formed swath by swath.

A drop ejector in a drop-on-demand inkjet printhead includes a pressure chamber having an ink inlet for providing ink to the pressure chamber, and a nozzle for jetting drops out of the chamber. Two side-by-side drop ejectors are shown in prior art FIG. 1 (adapted from U.S. Pat. No. 7,163,278) as an example of a conventional thermal inkjet drop on demand drop ejector configuration. Partition walls 20 are formed on a base plate 10 and define pressure chambers 22. A nozzle plate 30 is formed on the partition walls 20 and includes nozzles 32, each nozzle 32 being disposed over a corresponding pressure chamber 22. Ink enters pressure chambers 22 by first going through an opening in base plate 10, or around an edge of base plate 10, and then through ink inlets 24, as indicated by the arrows in FIG. 1. A heater 35, which functions as the actuator, is formed on the surface of the base plate 10 within each pressure chamber 22. Heater 35 is configured to selectively pressurize the pressure chamber 22 by rapid boiling of a portion of the ink in order to eject drops of ink through the nozzle 32 when an energizing pulse of appropriate amplitude and duration is provided.

Other types of actuators that use resistive heaters to selectively pressurize the pressure chamber for drop ejection include thermal actuators that have a multi-layer cantilevered element that is caused to rapidly bend toward the nozzle when the resistive heater layer is pulsed. Less heating of the ink is required than for thermal inkjet, where the ink is locally vaporized to provide the ejection pressure.

Drop ejectors in drop-on-demand inkjet printheads work well within a given temperature range. Printhead temperature can vary due to variation in ambient temperature as well as to temperature rise associated with the energy dissipated on the printhead during operation. A known problem in drop-on-demand inkjet printing is the degradation in output print quality due to temperature-related changes in the volume of ink that is ejected. One reason why the size of ejected drops increases with temperature of the printhead is that ink viscosity decreases with increased temperature. In addition, for thermal inkjet printheads, the amount of ink that is vaporized by a resistive heater during a printing pulse increases with increased printhead temperature. Although a significant portion of the heat is carried off by the ejected ink drops, some of the heat remains in the printhead and results in an increased temperature. At sufficiently high temperature the drop ejection can become unreliable, resulting in missing dots in the printed image.

Various printhead temperature control and pulse waveform control systems and methods are known in the prior art for sensing inkjet printhead temperature and using sensed temperature signals to compensate for temperature fluctuations. The approach in printhead temperature control is to keep the printhead within a narrow temperature range by auxiliary heating or cooling for example. In pulse waveform control the approach is to tailor the pulses that are provided to the resistive heaters in order to compensate for temperature changes on the printhead so that the drop volume remains substantially constant. In both approaches it is important to have an accurate measurement of temperature in the vicinity of the drop ejectors.

U.S. Pat. No. 4,910,528 discloses an analog temperature sensing system where a thin film thermal sensing resistor (i.e. a thermistor) is formed on the same substrate as the drop ejectors in order to provide a temperature measurement that corresponds closely to the temperature of the drop ejector substrate. It is disclosed that preferably four leads are attached to the thermistor where two of the leads provide a current and the other two leads are used to output the voltage drop across the thermistor.

U.S. Pat. No. 4,791,435 discloses a thermal inkjet printhead temperature control system that regulates the temperature of a printhead using a temperature sensing device and a heating component. The temperature sensing device includes either a collection of transducers or a single thermistor located on the drop ejector substrate or on a printed circuit board to which the printhead is attached.

U.S. Pat. No. 5,075,690 discloses an analog temperature sensor that is formed on the drop ejector substrate and extends along the length of the array of drop ejectors. Recognizing that manufacturing variations in the thermistor can result in large inaccuracies in temperature measurement, a factory calibration is disclosed where a resistor in series with the thermistor is trimmed, for example by laser trimming, while the printhead is held at a set point temperature. Other methods of factory calibration of the thermistor on an inkjet printhead are described in U.S. Pat. No. 5,881,451 and U.S. Pat. No. 7,572,051.

The analog measurement of a temperature sensor such as a thermistor can be converted to a digital signal by an analog to digital converter for use in control circuitry as disclosed in U.S. Pat. No. 6,302,507 and in U.S. Pat. No. 6,322,189. Another alternative for providing a digital signal is to provide temperature controlled oscillator circuitry on the drop ejector substrate. Temperature controlled oscillators are described in U.S. Pat. No. 5,388,134 and typically include a thermistor as the temperature sensitive element. The number of counts recorded by a counter during a given time interval (i.e. the frequency of the oscillator signal) changes approximately linearly with temperature. Various implementations of temperature controlled oscillators on inkjet printheads are disclosed in U.S. Pat. No. 5,745,130, U.S. Pat. No. 6,037,831, U.S. Pat. No. 6,278,468, and U.S. Pat. No. 8,419,158.

In some of the prior art references listed above, such as U.S. Pat. No. 5,745,130, U.S. Pat. No. 6,302,507, U.S. Pat. No. 7,572,051 and U.S. Pat. No. 8,419,158 a plurality of small temperature sensors are located in various parts of the drop ejector substrate either for obtaining an average temperature measurement on the drop ejector substrate or for independently measuring the temperature in different locations on the drop ejector substrate. Typically for measuring temperature in different locations using temperature sensors formed on the drop ejector substrate, additional output leads are required as shown in prior art FIG. 2 adapted from U.S. Pat. No. 5,467,113. Drop ejector array substrate 1 includes temperature sensors 2*a* and 2*b*, an array of drop ejection heaters 3, and warming heaters 8*a* and 8*b* for maintaining the temperature within a predetermined range. Warming heaters 8*a* and 8*b* are individually and independently controlled in response to the outputs from the temperature sensors 2*a* and 2*b* respectively Temperature sensors 2*a* and 2*b* are connected to different output pads (not labeled) that are located near the bottom edge of the drop ejector array substrate.

As indicated above, drop volume tends to increase with increased temperature of the printhead and ink. It is also known that drop volume can be affected by the pulse waveform. As disclosed in U.S. Pat. No. 4,982,199, ink in the vicinity of the nozzle of a drop ejector can be pre-warmed by pulsing the resistive heater using one or more pulses that have insufficient energy to form a vapor bubble of ink prior to the firing pulse that forms the vapor bubble. By pre-warming the ink, more of the ink in the nozzle region is brought to the vaporization temperature by the firing pulse before the transfer of heat to the ink from the resistive heater is interrupted by the formation of the vapor bubble. Vaporizing more of the ink forms a larger bubble, which provides the power for ejecting a larger drop of ink. Prior art FIGS. 3A to 3G are a copy of FIGS. 3A to 3G of U.S. Pat. No. 4,892,199. In each of FIGS. 3A to 3G the dashed line represents a pulsing level that is sufficient to form a vapor bubble. Three firing pulses (unlabeled) are shown in FIG. 3A to 3G that extend beyond the dashed line. The firing pulses are preceded by pre-warming pulses (unlabeled) of different shapes, widths, numbers and amplitudes. U.S. Pat. No. 4,982,199 contemplated the use of pre-warming pulses for use in gray-scaling rather than for compensation of drop volume for temperature variation.

U.S. Pat. No. 5,036,377 disclosed attaching a temperature sensor to a surface of the drop ejector substrate. The resistive heaters on the drop ejector substrate are connected to drivers that are not on the drop ejector substrate. Temperature signals from the temperature sensor are sent to a controller, and the controller enables actuation of selected resistive heaters through the drivers using packets of electrical pulses. A digital clock signal is also provided to the controller. It is disclosed that pulse widths, idle times between pulses or number of pulses per packet can be increased or decreased by one or more clock units to change the pulse waveform in order to control drop volume in response to the temperature measured by the temperature sensor according to a look-up table that provides data to the controller. U.S. Pat. No. 5,917,509 discloses one or more precursor pulses (or warming pulses) that are applied to the resistive heater for warming the ink nearby, followed by a print pulse that causes a drop of ink to be ejected.

Despite the previous advances in temperature sensing as well as temperature control and drop volume control on inkjet printheads, what is still needed are printing system designs and printing methods that provide individual temperature sensing and corresponding pulse waveform compensation for different locations on a drop ejector array substrate. In addition, it is desirable to provide drop ejector arrays having a small number of input/output connections, while still providing drop volume control for drop ejectors in different locations on a drop ejector array substrate that can be at different temperatures.

SUMMARY OF THE INVENTION

According to an aspect of the present invention, an inkjet printing system includes at least one drop ejector array module. Each drop ejector array module includes a substrate having an array of drop ejectors disposed on the substrate. Each drop ejector includes a nozzle, an ink inlet, a pressure chamber in fluidic communication with the nozzle and the ink inlet, and an actuator configured to selectively pressurize the pressure chamber for ejecting ink through the nozzle. A primary temperature sensor is disposed on the drop ejector array substrate in a first location near to a first set of drop ejectors. At least one secondary temperature sensor disposed on the substrate in a second location near to a second set of drop ejectors. Temperature comparison circuitry is disposed on the substrate, and is configured to compare signals from the primary temperature sensor and the at least one secondary temperature sensor. Pulse modification circuitry disposed on the substrate is electrically connected to the temperature comparison circuitry and is configured to modify an input pulse waveform. A temperature output pad on the drop ejector array module is connected to the primary temperature sensor. A pulse waveform input pad on the drop ejector array module is connected to the pulse modification circuitry. The inkjet printing system also includes a controller that is electrically connected to the primary temperature sensor via the temperature output pad and to the pulse modification circuitry via the pulse waveform input pad. In some embodiments the inkjet printing system further includes a reference temperature sensor that is separate from the at least one drop ejector array module. In such embodiments the controller is electrically connected to the reference temperature sensor and to the temperature output pad of the at least one drop ejector array module, and is configured to calibrate the primary temperature sensor on the at least one drop ejector array module.

According to another aspect of the present invention, a method is provided for controlling actuation of drop ejectors disposed at different locations on a drop ejector array module having a primary temperature sensor in a first location near to a first set of drop ejectors and a secondary temperature sensor in a second location near to a second set of drop ejectors. The method includes performing a first temperature measurement with the primary temperature sensor and performing a second temperature measurement with the secondary temperature sensor. A temperature difference between the first temperature measurement and the second temperature measurement is determined using temperature comparison circuitry disposed on the drop ejector array module. A controller receives the first temperature measurement, determines electrical pulse waveforms corresponding to the first temperature measurement, and sends the electrical pulse waveforms corresponding to the first temperature measurement to the drop ejector array module. The electrical pulse waveforms are used to provide first actuation pulse waveforms to the first set of drop ejectors corresponding to the first temperature measurement. Pulse modification circuitry disposed on the drop ejector array module is used to modify the first actuation pulse waveforms based on the temperature difference measured by the comparison circuitry to provide second actuation pulse waveforms to the second set of drop ejectors.

This invention has the advantage that drop volume control is provided for drop ejectors in different locations on a drop ejector array substrate that can be at different temperatures. It has the additional advantage that only a small number of input/output pads are required. A further advantage is that the temperature sensor can be calibrated within the printing system.

BRIEF DESCRIPTION OF THE DRAWINGS

It is to be understood that the attached drawings are for purposes of illustrating the concepts of the invention and may not be to scale. Identical reference numerals have been used, where possible, to designate identical features that are common to the figures.

DETAILED DESCRIPTION OF THE INVENTION

The invention is inclusive of combinations of the embodiments described herein. References to "a particular embodiment" and the like refer to features that are present in at least one embodiment of the invention. Separate references to "an embodiment" or "particular embodiments" or the like do not necessarily refer to the same embodiment or embodiments; however, such embodiments are not mutually exclusive, unless so indicated or as are readily apparent to one of skill in the art. The use of singular or plural in referring to the "method" or "methods" and the like is not limiting. It should be noted that, unless otherwise explicitly noted or required by context, the word "or" is used in this disclosure in a non-exclusive sense.

Figure 4:
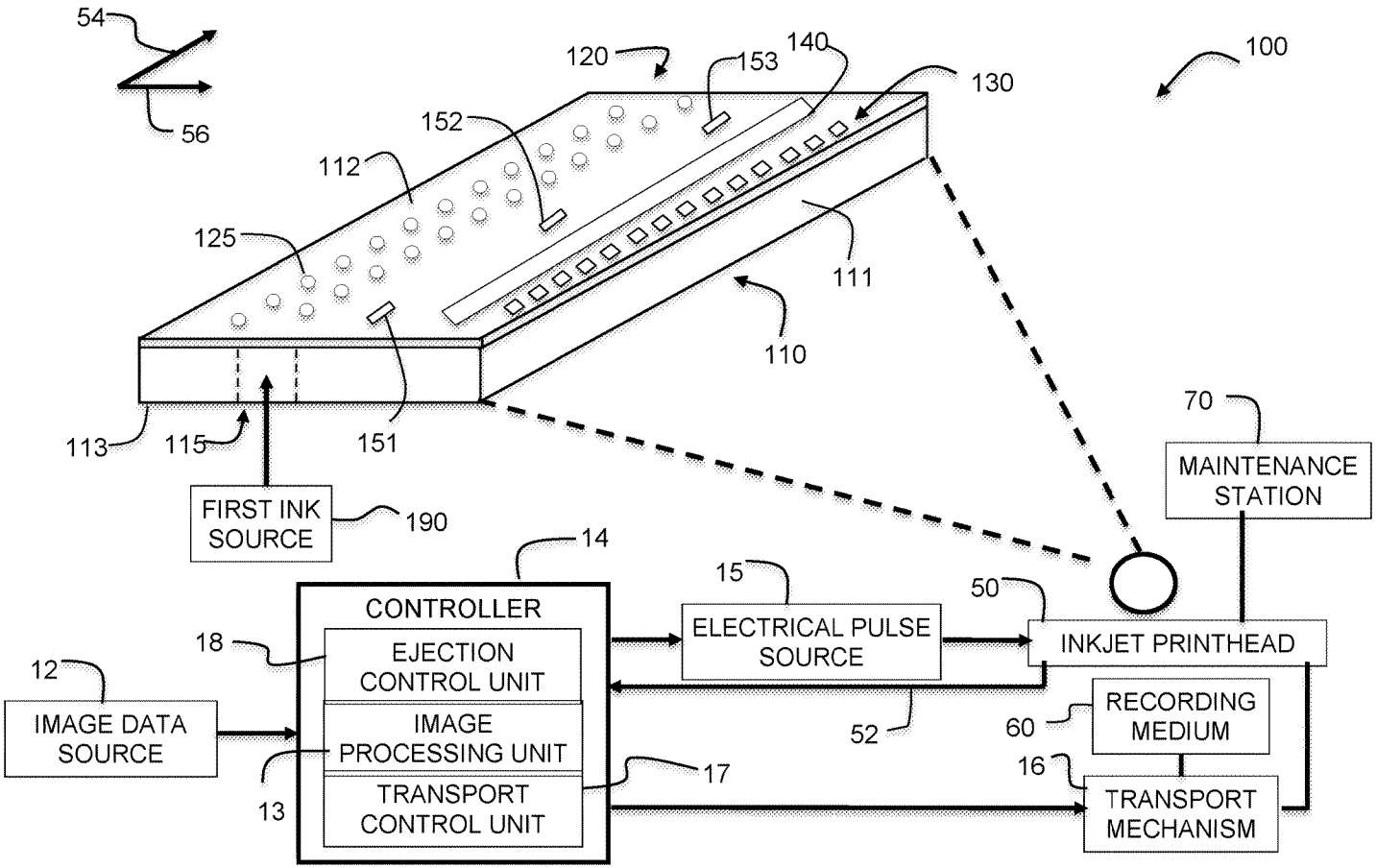
FIG. 4 is a schematic representation of an inkjet printing system according to an embodiment.

FIG. 4 shows a schematic representation of an inkjet printing system 100 together with a perspective of drop ejector array module 110. Drop ejector array module 110 can also be called a printhead die. Image data source 12 provides data signals that are interpreted by a controller 14 as commands for ejecting drops. Controller 14 includes an image processing unit 13 for rendering images for printing. The term "image" is meant herein to include any pattern of dots directed by the image data. It can include graphic or text images. It can also include patterns of dots for printing functional devices if appropriate inks are used. Controller 14 also includes a transport control unit 17 for controlling transport mechanism 16 and an ejection control unit 18 for ejecting ink drops to print a pattern of dots corresponding to the image data on the recording medium 60. Controller 14 sends output signals to an electrical pulse source 15 for sending electrical pulses to an inkjet printhead 50 that includes at least one drop ejector array module 110. A printhead output line 52 is provided for sending electrical signals from the printhead 50 to the controller 14 or to sections of the controller 14, such as the ejection control unit 18. For example, as described below with reference to FIG. 5, printhead output line 52 can carry a temperature measurement signal from printhead 50 to the ejection control unit 18 of controller 14. Transport mechanism 16 provides relative motion between inkjet printhead 50 and recording medium 60 along a scan direction 56. Transport mechanism 16 is configured to move the recording medium 60 along scan direction 56 while the printhead 50 is stationary in some embodiments. Alternatively, transport mechanism 16 can move the printhead 50, for example on a carriage, past stationary recording medium 60. Various types of recording media for inkjet printing include paper, plastic, and textiles. In a 3D inkjet printer, the recording media include flat building platform and thin layer of powder material. In addition, in various embodiments recording medium 60 can be web fed from a roll or sheet fed from an input tray.

Figure 1:
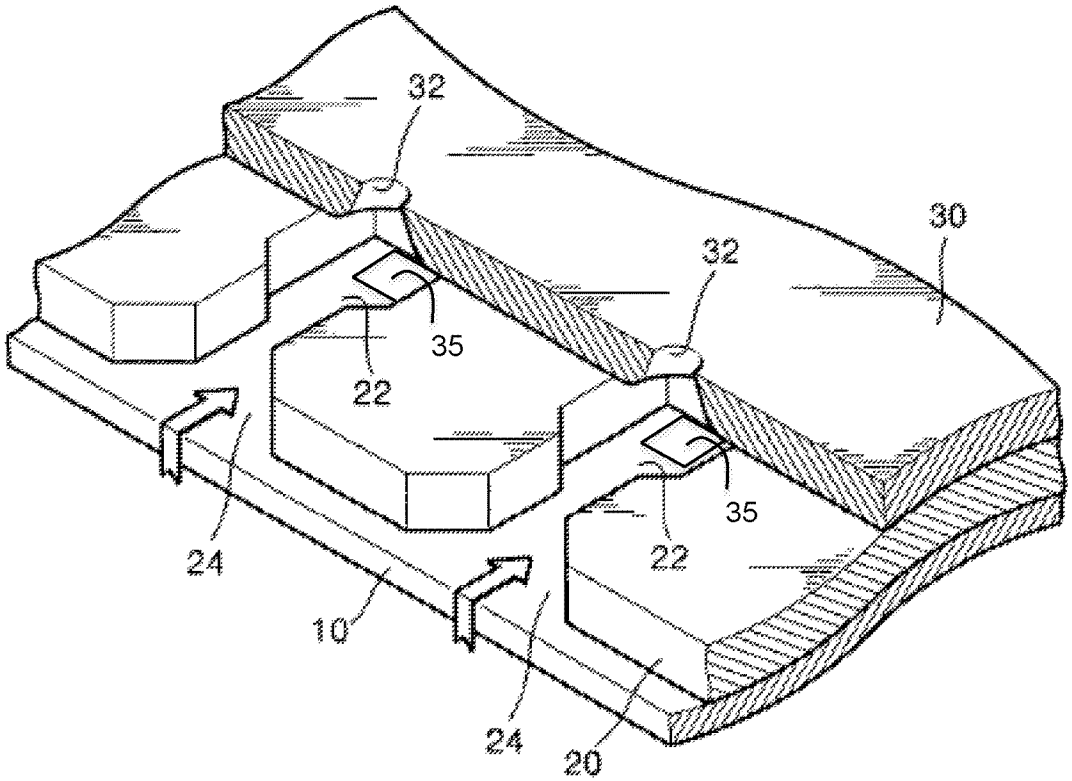
FIG. 1 shows a perspective of a prior art drop ejector configuration.
Figure 2:
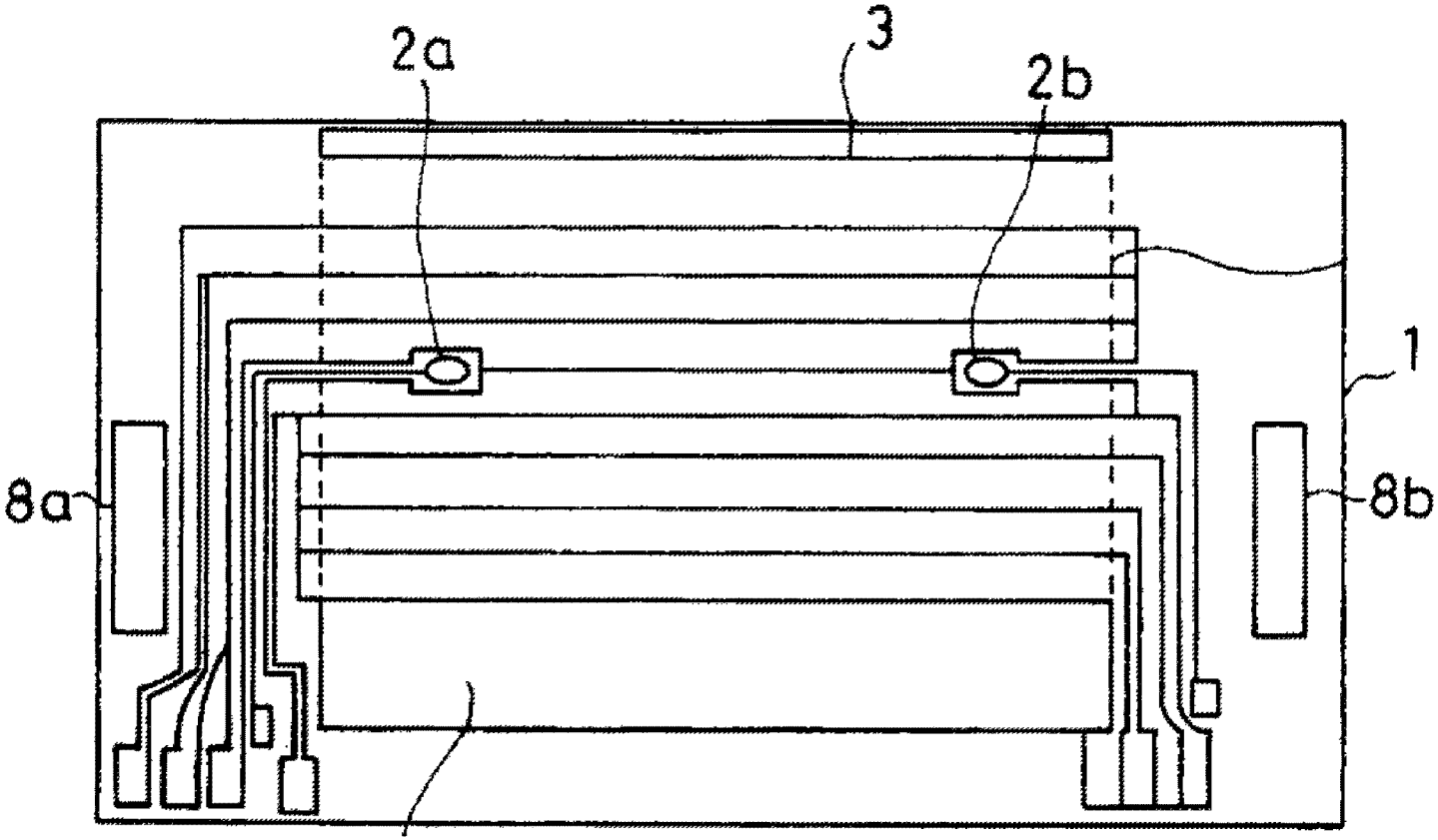
FIG. 2 shows a top view of a prior art drop ejector array substrate having a plurality of temperature sensors.
Figure 3:
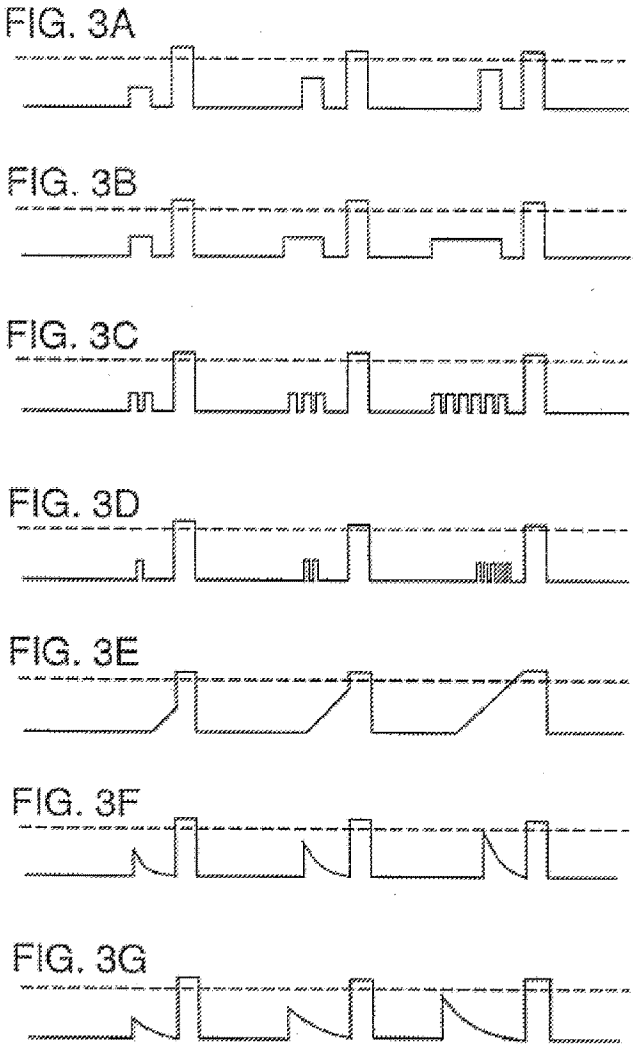
FIGS. 3A-3G are prior art pulse waveforms used for drop volume control.

Printhead die 110 includes at least one drop ejector array 120 including a plurality of drop ejectors 125 formed on a top surface 112 of a substrate 111 that can be made of silicon or other appropriate material. In the example shown in FIG. 4, drop ejector array 120 includes a pair of rows of drop ejectors 125 that extend along array direction 54 and that are staggered with respect to each other in order to provide increased printing resolution. Ink is provided to drop ejectors 125 by first ink source 190 through ink feed 115 which extends from the back surface 113 of substrate 111 toward the top surface 112. Ink source 190 is generically understood herein to include any substance that can be ejected from an inkjet printhead drop ejector. Ink source 190 can include colored ink such as cyan, magenta, yellow or black. Alternatively ink source 190 can include conductive material, dielectric material, magnetic material, or semiconductor material for functional printing. Ink source 190 can alternatively include biological or other materials. For simplicity, location of the drop ejectors 125 is represented by the circular nozzle. Not shown in FIG. 4 are the pressure chamber 22, the ink inlet 24, or the actuator 35 (FIG. 1). Ink inlet 24 is configured to be in fluidic communication with first ink source 190. The pressure chamber 22 is in fluidic communication with the nozzle 32 (FIG. 1) and the ink inlet 24. The actuator 35 is configured to selectively pressurize the pressure chamber 22 for ejecting ink through the nozzle 32. Printhead die 110 includes a group 130 of input/output pads for sending signals to and sending signals from printhead die 110 respectively. Printhead die 110 also includes logic circuitry 140 for processing electrical signals. In addition, printhead die 110 includes a plurality of temperature sensors 151, 152 and 153 disposed in different locations near different sets of drop ejectors 125.

Maintenance station 70 keeps the drop ejectors 125 of printhead die 110 on printhead 50 in proper condition for reliable printing. Maintenance can include operations such as wiping the top surface 112 of printhead die 110 in order to remove excess ink, or applying suction to the drop ejector array 120 in order to prime the nozzles. Maintenance operations can also include spitting, i.e. the firing of non-printing ink drops into a reservoir in order to provide fresh ink to the pressure chambers and the nozzles, especially if the drop ejectors have not been fired recently. Volatile components of the ink can evaporate through the nozzle over a period of time and the resulting increased viscosity can make jetting unreliable.

Figure 5:
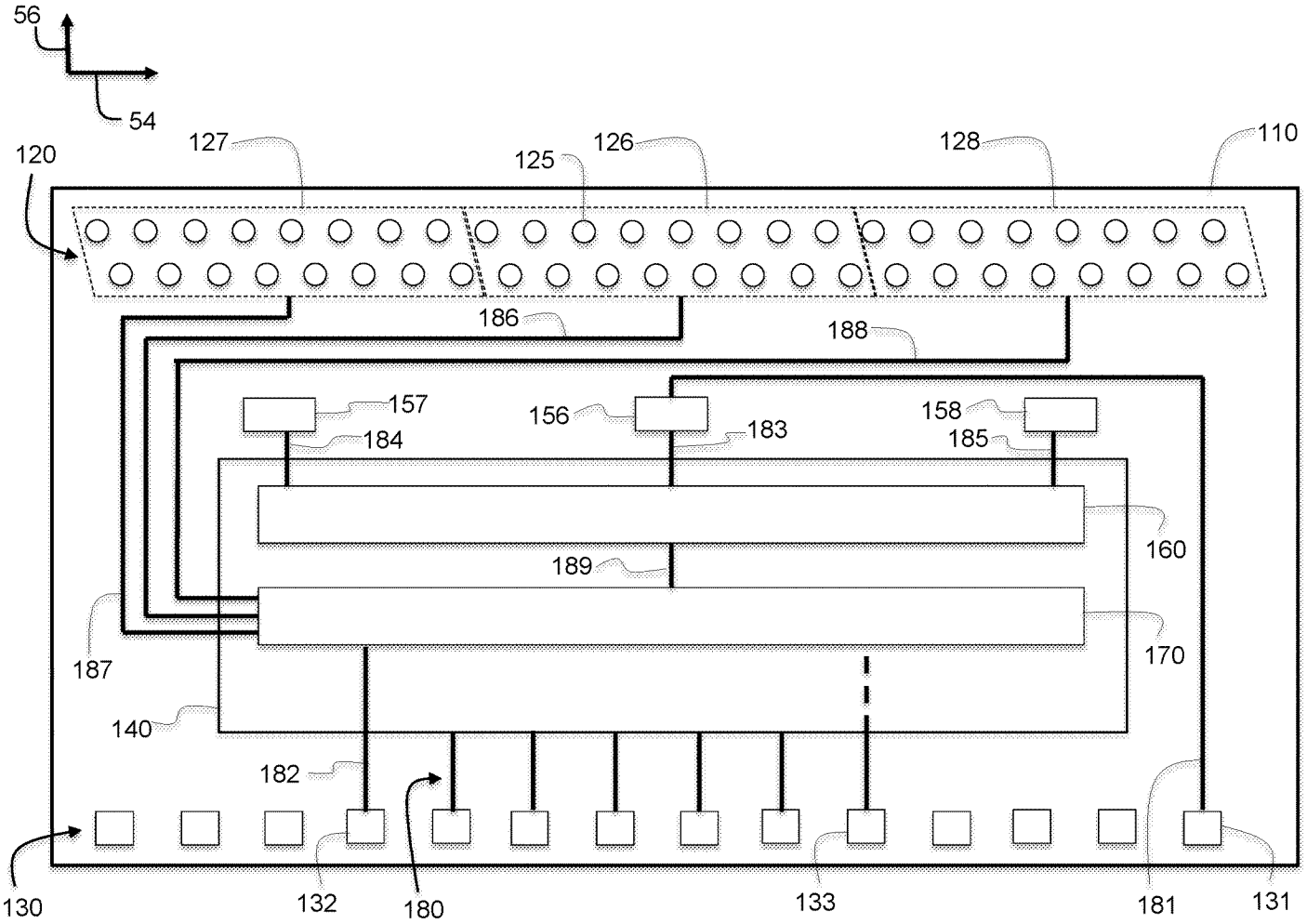
FIG. 5 is a top view of a drop ejector array module according to an embodiment.

FIG. 5 shows a more detailed top view of drop ejector array module 110, according to an embodiment of the present invention. Drop ejector array module 110 includes a drop ejector array 120 including two staggered rows of drop ejectors 125 disposed along array direction 54. In many embodiments driver transistors (not shown) are connected to the actuators (e.g. resistive heaters) of corresponding drop ejectors 125 in order to provide the energizing pulses. Three sets of drop ejectors 125 in drop ejector array 120 are shown in FIG. 5. A first set 126 is disposed near the middle of the array, a second set 127 is disposed near the left side of the array, and a third set 128 is disposed near the right side of the array. Located near the first set 126 of drop ejectors 125 is a primary temperature sensor 156 that measures a temperature in the region of the first set 126. Located near the second set 127 of drop ejectors 125 is a secondary temperature sensor 157 that measures temperature in the region of the second set. Located near the third set 128 of drop ejectors 125 is another secondary temperature sensor 158 that measures temperature in the region of the third set 128. Primary temperature sensor 156 can be nominally the same as secondary temperature sensors 157 and 158, but it differs in terms of how it is connected and how it is used, as described below. For example, primary temperature sensor 156, and secondary temperature sensors 157 and 158 can all be thermistors formed on the top surface 112 of substrate 111 (FIG. 4) having nominally the same resistance and nominally the same temperature coefficient of resistance as each other. Alternatively, the primary temperature sensor 156 and the secondary temperature sensors 157 and 158 can all be temperature controlled oscillators that provide nominally the same frequency at the same temperature. For the case of temperature controlled oscillators, it is not required that the circuitry associated with the oscillators is located near the corresponding sets of drop ejectors as described above, only that the temperature sensing elements of the temperature controlled oscillators are located near the corresponding sets of drop ejectors. As shown in FIG. 5, drop ejector array module 110 includes temperature comparison circuitry 160 and pulse modification circuitry 170 within logic circuitry 140. Alternatively the temperature comparison circuitry 160 and pulse modification circuitry 170 can be thought of as separate from the logic circuitry 140. A primary function of logic circuitry 140 is to process signals from controller 14 and electrical pulse source 15 (FIG. 4) and provide appropriate pulse waveforms at the proper times to the drop ejectors 125 of drop ejector array 120 in order to print an image corresponding to data from image processing unit 13. Logic circuitry 140 can include circuit elements such as shift registers, gates and latches that are associated with inputs for functions including providing data, timing, and resets as described for example in U.S. Pat. No. 5,917,509 that was referenced above. Drop ejector array module 110 includes a group 130 of input/output pads, a number of which are connected to logic circuitry 140 by leads 180. In some embodiments a clock input pad 133 is connected to logic circuitry 140 and is also connected to pulse modification circuitry 170. Leads from some of the pads are not shown for simplicity. Such pads can be used to provide ground, logic voltage, ejector voltage or other functions.

Temperature comparison circuitry 160 makes it possible to sense the temperature in different regions of drop ejector array module 110 without requiring an output pad for each temperature sensor. Temperature output pad 131 is connected to the primary temperature sensor 156 by lead 181, but no output pads are provided for secondary temperature sensors 157 and 158. Instead, primary temperature sensor 156, secondary temperature sensor 157 and secondary temperature sensor 158 are connected to temperature comparison circuitry 160 by connections 183, 184 and 185 respectively. Although single lines are shown for representing leads from the group 130 of input/output pads and for other connections within drop ejector array module 110, it is to be understood herein that each single line can represent more than one electrical trace. Temperature comparison circuitry 160 is used to determine a temperature difference between a first temperature measurement made using the primary temperature sensor 156 and a second (or third) temperature measurement made using a secondary temperature sensor 157 (or 158). Differences in temperature along drop ejector array 120 can occur due to uneven printing usage by first set 126, second set 127 and third set 128 of drop ejectors 125. For example, if the image data has recently required relatively heavy printing usage by second set 127 and lighter printing usage by first set 126 and third set 128, then the temperature measured by secondary temperature sensor 157 can be higher than the temperature measured by either primary temperature sensor 156 or secondary temperature sensor 158. Rather than controlling pulse waveforms for drop volume control based on an average temperature on the drop ejector array module 110, or on the temperature signal provided at temperature output pad 131 (corresponding to the temperature measured by primary temperature sensor 156), pulse waveform control can be provided independently for the various regions of drop ejector array 120.

For embodiments where primary temperature sensor 156, secondary temperature sensor 157 and secondary temperature sensor 158 are all thermistors, temperature comparison circuitry 160 can operate by comparing a signal corresponding to the resistance of the thermistor of primary temperature sensor 156 with signals corresponding to the resistances of the thermistors of secondary temperature sensors 157 and 158 respectively. Alternatively, signals representing voltage drops across the respective thermistors can be compared. For embodiments where primary temperature sensor 156, secondary temperature sensor 157 and secondary temperature sensor 158 are all temperature controlled oscillators, a frequency of a signal from primary temperature sensor 156 is compared to a frequency of a signal from secondary temperature sensor 157 and a frequency of a signal from secondary temperature sensor 158. Temperature comparison circuitry 160 makes comparisons on an ongoing basis so that temperature differences between the primary temperature sensor 156 and the secondary temperature sensors 157 and 158 are updated continually during the printing process.

In response to the temperature that is measured by primary temperature sensor 156 and sent to controller 14 via temperature output pad 131 and printhead output line 52

(FIG. 4), ejection control unit 18 of controller 14 controls electrical pulse source 15 to send corresponding electrical pulse waveforms to drop ejector array module via pulse waveform input pad 132. These electrical pulse waveforms are transmitted to pulse modification circuitry 170 by lead 182.

FIGS. 6A-6F show examples of pulse waveforms 201-206 that can be used to control drop volume at six different temperatures where $T_6>T_5>T_4>T_3>T_2>T_1$. Pulse waveforms 201-206 are meant to be illustrative of the types of waveforms that can be used to control drop volume as a function of temperature and do not necessarily conform to actual waveforms at particular temperatures. A typical temperature range over which pulse waveforms can control drop volume for thermal inkjet printheads can be from around 15 C to 50 C.

Figures 6A, 6B, 6C, 6D, 6E, 6F:
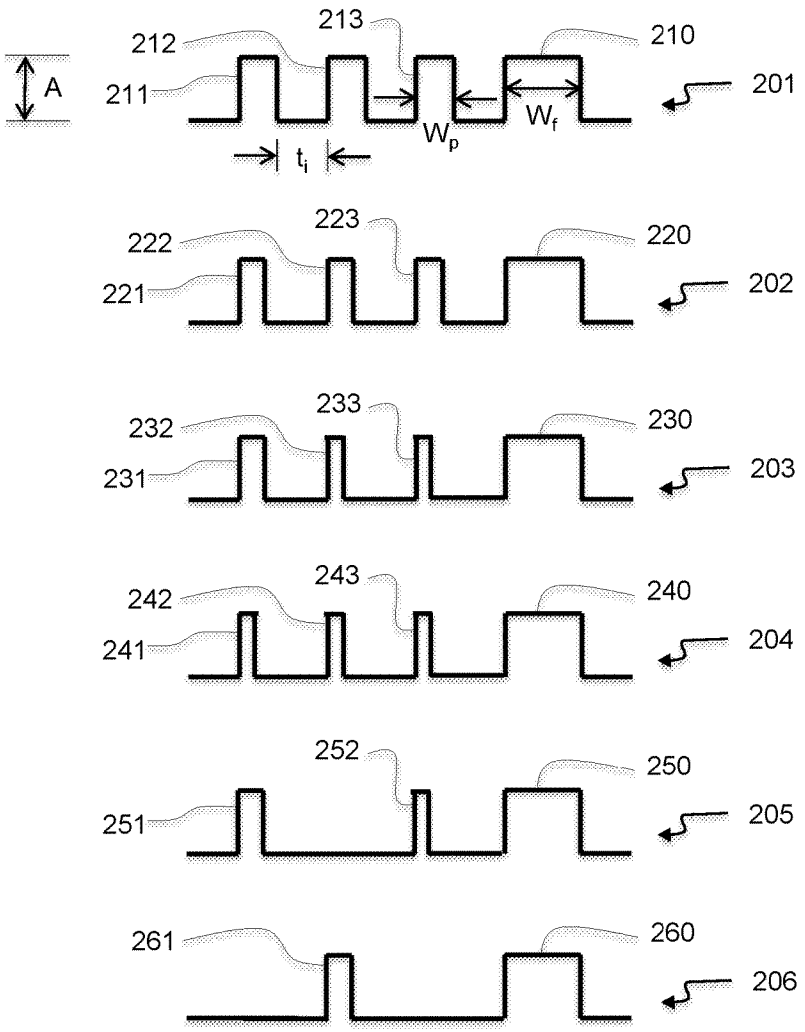
FIGS. 6A-6F are exemplary pulse waveforms for drop volume control as a function of temperature according to an embodiment.

FIG. 6A shows an example of a pulse waveform 201 that can be used at temperature $T_1$, where $T_1$ is toward the lower end of the temperature range of control. The resistive heater of the drop ejector is pulsed with three precursor pulses 211, 212 and 213 in order to warm the ink in the pressure chamber near the nozzle of the drop ejector prior to the firing pulse 210. The three precursor pulses 211, 212 and 213 have substantially equal pulse widths $W_p$ that are not of sufficiently long duration to vaporize the ink and are separated by idle times $t_i$ during which the heat propagates into the nearby ink. In some embodiments pulse amplitude A can be on the order of 20 to 30 volts, for example. Following the precursor pulses 211-213, the resistive heater is pulsed with a firing pulse 210 of the same pulse amplitude A, but with a longer pulse width $W_f$ that causes formation of a vapor bubble in the ink to eject an ink drop through the nozzle.

FIG. 6B shows an example of a pulse waveform 202 that can be used at a temperature $T_2$ that is greater than $T_1$, but is still toward the lower end of the temperature range of control. The three precursor pulses 221, 222 and 223 have smaller pulse widths $W_p$ and larger idle times $t_i$ than the corresponding pulses 211, 212 and 213 of pulse waveform 201, because not as much pre-warming of the ink is required at the higher temperature $T_2$. Firing pulse 220 is similar to firing pulse 210 of pulse waveform 201.

FIG. 6C shows an example of a pulse waveform 203 that can be used at a temperature $T_3$ that is greater than $T_2$ and is at the lower mid-range of control. Precursor pulse 231 has substantially the same pulse width $W_p$ as the corresponding precursor pulse 221 of pulse waveform 202. Precursor pulses 232 and 233 have smaller pulse widths $W_p$ and larger idle times $t_i$ than the corresponding pulses 222 and 223 of pulse waveform 202, because not as much pre-warming of the ink is required at the higher temperature $T_3$. Firing pulse 230 is similar to firing pulse 210 of pulse waveform 201.

FIG. 6D shows an example of a pulse waveform 204 that can be used at a temperature $T_4$ that is greater than $T_3$ and is near the mid-range of control. The three precursor pulses 241, 242 and 243 all have substantially the same short pulse widths $W_p$ as the precursor pulses 232 and 233 of pulse waveform 203. Firing pulse 240 is similar to firing pulse 210 of pulse waveform 201.

FIG. 6E shows an example of a pulse waveform 205 that can be used at a temperature $T_5$ that is greater than $T_4$ and is toward the upper temperature range of control. There are only two precursor pulses 251 and 252 rather than three. Pulse waveform 205 is similar to pulse waveform 203 described above without precursor pulse 232. Firing pulse 250 is similar to firing pulse 210 of pulse waveform 201.

FIG. 6F shows an example of a pulse waveform 206 that can be used at a temperature $T_6$ that is greater than $T_5$ and is toward the upper range of temperature control. There is only one precursor pulse 261. Its pulse width is similar to that of the precursor pulses 221, 222 and 223 in pulse waveform 202. At still higher temperatures a smaller precursor pulse width or no precursor pulse can be used. Firing pulse 260 is similar to firing pulse 210 of pulse waveform 201.

Pulse waveforms 201-206 of FIGS. 6A-6F are illustrative and do not represent an entire set of waveforms for an entire temperature range of drop volume control. For example, there can be pulse waveforms for temperatures below $T_1$ that would be characterized by providing more pre-warming to the ink, by having a greater number of precursor pulses or wider precursor pulse widths $W_p$. Similarly, for example, there can be pulse waveforms for temperatures between $T_2$ and $T_3$ for providing an intermediate amount of pre-warming between that provided by pulse waveforms 202 (FIG. 6B) and 203 (FIG. 6C). For example, instead of having one wider precursor pulse 231 and two narrow precursor pulses 232 and 233 as in pulse waveform 203 of FIG. 6C, there can be two wider precursor pulses and one narrow precursor pulse for a temperature between $T_2$ and $T_3$.

In the examples shown in FIGS. 6A-6F the firing pulse width is unchanged. In other embodiments (not shown) the firing pulse width $W_f$ can change as a function of temperature. Also in the examples shown in FIGS. 6A-6F the pulse amplitude A remains substantially constant for the precursor pulses and the firing pulses. In other embodiments (not shown) the pulse amplitude A can change as a function of temperature.

In previous implementations of drop volume control using pulse waveforms to compensate for the tendency of drop volume to increase with temperature, a temperature measurement representing a group of drop ejectors 125 would be sent periodically to the controller 14. In response to the most recent temperature measurement the controller would send pulse waveforms to be used by the entire group of drop ejectors 125. For example, if a drop ejector array module 110 had a single temperature sensor, the temperature measured by that temperature sensor 110 would be used by the controller to determine the pulse waveform to be used for all of the drop ejectors 120 on the drop ejector array module. For a printhead 50 having a plurality of drop ejector array modules 110, a single temperature measurement would be used to characterize each drop ejector array module 110 and the controller 14 would send pulse waveforms which could differ for the different drop ejector array modules 110.

In embodiments of the invention it is recognized that temperature can vary across the drop ejector array module 110 so that it can be advantageous to use different pulse waveforms for first set 126, second set 127 and third set 128 (FIG. 5) of drop ejectors 125 on drop ejector array module 110 corresponding to the temperatures measured by temperature sensors 156, 157 and 158 respectively. However, it is also advantageous to keep the number of input and output pads in group 130 relatively small. Therefore in embodiments of the invention, only the temperature signal corresponding to the primary temperature sensor 156 is sent to the controller 14 via temperature output pad 131. In response the controller 14 sends pulse waveforms corresponding to the temperature signal from the primary temperature sensor 156. If the temperature comparison circuitry 160 determines that the temperatures measured by secondary temperature sensors 157 and 158 are sufficiently close to the primary temperature sensor 156, the pulse waveforms sent by the controller 14 can be used for first set 126, second set 127 and third set 128 of drop ejectors 125.

However, if the temperatures measured by secondary temperature sensors 157 or 158 are sufficiently different from the temperature measured by primary temperature sensor 156, the pulse modification circuitry 170 on drop ejector array module 110 can be used for modifying the pulse waveforms as appropriate for drop ejectors 125 in different regions of the drop ejector array module 110. An example of how the pulse modification circuitry 170 operates can be understood with reference to FIGS. 6A-6F. Suppose temperature $T_3$ is measured by primary temperature sensor 156. In addition, suppose temperature comparison circuitry 160 indicates that the temperature signal from secondary temperature sensor 157 corresponds to a higher temperature and the temperature signal from secondary temperature sensor 158 corresponds to a lower temperature than that measured by primary temperature sensor 156. Ejection control unit 18 (FIG. 4) of controller 14 will direct electrical pulse source 15 to send electrical pulse waveform 203 (FIG. 6C) to pulse waveform input pad 132. Pulse waveform 203 can be used without modification of pulse widths $W_p$ and idle times $t_i$ to provide first actuation pulse waveforms via connection 186 to the first set 126 of drop ejectors at the appropriate times. In some embodiments the first actuation pulse waveforms are identical to the electrical pulse waveform (e.g. 203). In other embodiments, the first actuation pulse waveforms have similar timing as the electrical pulse waveform but have different amplitude (e.g. a higher voltage) for switching on the drive transistors (not shown) that pulse the resistive heaters in the drop ejectors. Pulse modification circuitry 170 modifies the first actuation pulse waveform to provide second actuation pulse waveforms having a shape like pulse waveform 204 (FIG. 6D) to second set 127 of drop ejectors 125 (i.e. to the drive transistors associated with second set 127) via connection 187 because the temperature comparison circuitry 160 indicated that secondary temperature sensor 157 had a higher temperature measurement than primary temperature sensor 156. For example, pulse modification circuitry 170 can subtract a predetermined number of clock pulses provided by clock input pad 133 from first precursor pulse 231 (FIG. 6C) to provide first precursor pulse 241 (FIG. 6D). In addition, pulse modification circuitry 170 modifies the first actuation pulse waveform to provide third actuation pulse waveforms having a shape like pulse waveform 202 (FIG. 6B) to third set 128 of drop ejectors 125 (i.e. to the drive transistors associated with third set 128) via connection 188 because the temperature comparison circuitry 160 indicated that secondary temperature sensor 158 had a lower temperature measurement than primary temperature sensor 156. For example, pulse modification circuitry 170 can add predetermined numbers of clock pulses provided by clock input pad 133 to second and third precursor pulses 232 and 233 (FIG. 6C) to provide second and third precursor pulses 222 and 223 (FIG. 6B).

When it is said herein that pulse modification circuitry 170 modifies first actuation pulse waveforms it is meant that the modified actuation pulse waveforms have a different shape than the first actuation pulse waveforms. It is not meant to imply that pulse modification operations are restricted to the sequence of providing the first actuation pulse waveforms from the electrical pulse waveforms that controller 14 sends to pulse waveform input pad 132 and then performing modification operations. The language is also meant to include optionally directly modifying the electrical pulse waveforms that controller 14 sends to pulse waveform input pad 132.

The substrate 111 (FIG. 4) of drop ejector array module 110 is typically made of silicon. Silicon is compatible with the fabrication of thermal inkjet drop ejectors and is also compatible with the fabrication of integrated circuitry required for the logic circuitry 140, the temperature comparison circuitry 160 and the pulse modification circuitry 170. Silicon is also an excellent thermal conductor. Temperature differences that are measured on the drop ejector array module 110 will tend to decrease over time due to heat flow through the silicon. Temperature differences on the drop ejector array module 110 are also highly dependent upon the print duty cycles of the first set 126, second set 127 and third set 128 of drop ejectors 125. In an embodiment the pulse modification circuitry 170 is configured or directed to modify the first actuation pulse waveforms based on the temperature difference measured by the temperature comparison circuitry 160 and to provide second actuation pulse waveforms to the second set 157 of drop ejectors 125 that correspond to a temperature that is between the first temperature measurement by the primary temperature sensor 156 and the second temperature measurement by secondary temperature sensor 157 (and similarly for the third set 158 of drop ejectors 125). For example, if primary temperature sensor 156 measures a temperature $T_4$ and secondary temperature sensor 157 measures a temperature $T_2$, the controller 14 will send electrical pulse waveform 204 (FIG. 6D) to pulse input pad 132. In this embodiment pulse modification circuitry 170 will modify pulse waveform shape to provide to the second set 127 of drop ejectors 125 second actuation pulse waveforms having the shape of pulse waveform 203 (FIG. 6C), for example, corresponding to a temperature $T_3$ that is between $T_2$ and $T_4$. The motivation in such embodiments is to avoid overshooting the drop volume correction via pulse waveform modification as heat flow through the silicon tends to moderate the temperature differences between different regions on the drop ejector array module 110.

In another embodiment the pulse modification circuitry 170 is configured or directed to modify the first actuation pulse waveforms based on the temperature difference measured by the temperature comparison circuitry 160 and to provide the modified actuation pulse waveforms to the first set 126 of drop ejectors 125. In other words, the shape of the actuation pulse waveforms used to pulse the resistive heaters of the first set 126 of drop ejectors can be different from the electrical pulse waveforms sent by controller 14 to pulse waveform input pad 132 in response to the temperature measurement made by primary temperature sensor 156. For example, if primary temperature sensor 156 measures a temperature $T_4$ and both secondary temperature sensor 157 and secondary temperature sensor 158 measure a temperature $T_2$, the controller 14 will send electrical pulse waveform 204 (FIG. 6D) to pulse input pad 132. In this embodiment pulse modification circuitry 170 will modify pulse waveform shape to provide to the first set 126 of drop ejectors 125 modified actuation pulse waveforms having the shape of pulse waveform 203 (FIG. 6C), for example, corresponding to a temperature $T_3$ that is between $T_2$ and $T_4$. Again, the motivation in such embodiments is to avoid overshooting the drop volume correction via pulse waveform modification as heat flow through the silicon tends to moderate the temperature differences between different regions on the drop ejector array module 110.

In the examples described above with reference to FIGS. 5 and 6A-6F, the pulse modification circuitry 170 modifies the first actuation pulse waveforms to provide modified actuation pulse waveforms to the first set 126 or the second set 127 (or likewise the third set 128) of drop ejectors by at least one changing of a precursor pulse width $W_p$, changing a number of precursor pulses, or changing an interval (i.e. idle time $t_i$) between pulses. In other embodiments (not shown), the pulse modification circuitry 170 can modify the firing pulse width $W_f$, or the amplitude A of any of the pulses.

Figure 7:
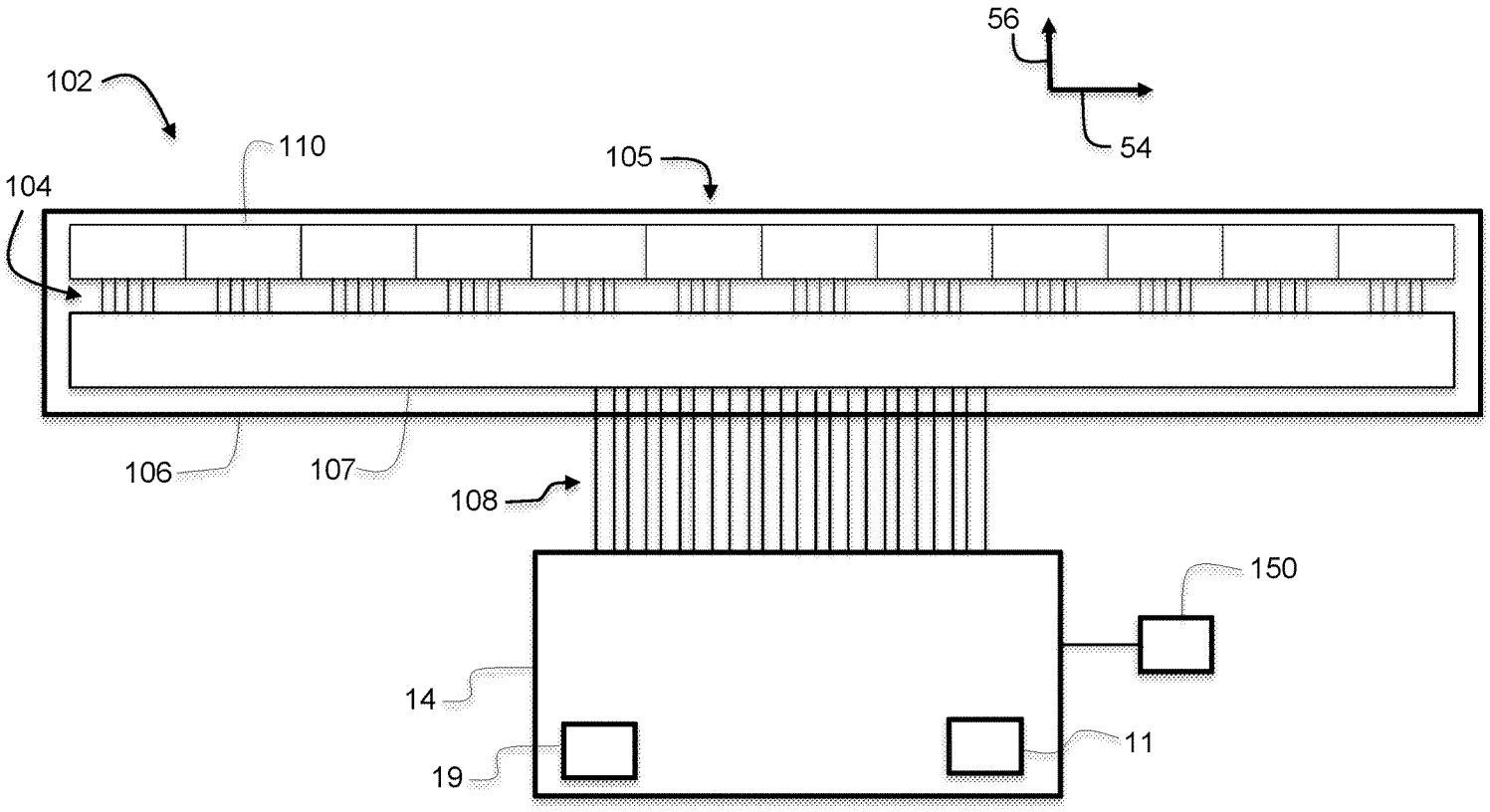
FIG. 7 is a schematic representation of a portion of an inkjet printing system having a pagewidth printhead according to an embodiment.

As indicated in the prior art, temperature sensors that are fabricated on drop ejector array modules typically need to be calibrated in order to provide an accurate temperature measurement. This is important for printheads having a single drop ejector array module, but even more important for printheads having a plurality of drop ejector array modules. FIG. 7 shows a portion of an inkjet printing system 102 having a pagewidth printhead 105 including a plurality of drop ejector array modules 110 that are arranged end to end along array direction 54 and affixed to mounting substrate 106. An interconnect board 107 is mounted on mounting substrate 106 and is connected to each of the drop ejector array modules 110 by interconnects 104 that can be wire bonds or tape automated bonding leads for example. A printhead cable 108 connects the interconnect board 107 to the controller 14. Some of the leads, such as the ground lead(s) in printhead cable 108 are common to all of the drop ejector array modules 110. Other leads, such as print data input, electrical pulse waveform input and temperature output are provided separately to each drop ejector array module 110. In other words, controller 14 is electrically connected to the temperature output pad of each of the drop ejector array modules 110. Recording medium 60 (FIG. 4) is moved along scan direction 56 by transport mechanism 16 (FIG. 4) for printing. Controller 14 controls the various functions of the inkjet printing system as described above with reference to FIG. 4. For simplicity, the various subsections of controller 14 are not shown in FIG. 7. A calibrated reference temperature sensor 150 is connected to controller 14. Reference temperature sensor 150 can be separate from controller 14 or it can be incorporated within controller 14 or mounted on interconnect board 107. In any case, reference temperature sensor 150 is separate from the drop ejector array modules 110.

Controller 14 is configured to calibrate the primary temperature sensor 156 (FIG. 5) on each of the drop ejector array modules 110. Calibration of the primary temperature sensors 156 is especially important in a printhead having a plurality of drop ejector array modules 110. Drop ejector array modules 110 are typically fabricated on silicon wafers that can have a diameter of 150 mm or greater. Wafers having a diameter less than about 250 mm are not large enough to provide printhead die that are larger than the width of a letter-sized page. Even for 300 mm diameter wafers that are large enough to provide printhead die that are larger than the width of a page, it is typically more cost effective (due to yield and optimizing the usable area on the wafer) to assemble a pagewidth printhead using drop ejector array modules 110 having a length along the array direction of around 1 to 2 cm. Due to typical manufacturing variability, devices that are fabricated near each other on the same wafer are generally substantially uniform, but devices that are fabricated on more distant locations on the wafer are less uniform. Even less uniform are devices that are fabricated on different wafers in the same batch, and even less uniform are devices that are fabricated at different times on wafers from different batches. As a result, for a drop ejector array module 110, secondary temperature sensors 157 and 158 will tend to have characteristics that are very close to those of the primary temperature sensor 156. However, on a pagewidth printhead 105 the primary temperature sensors 156 on different drop ejector array modules 110 can be quite different from each other.

Optionally the primary temperature sensor 156 for each drop ejector array module 110 can be calibrated in the factory as described in the prior art references cited above. However, such a calibration would need to be stored in memory on the pagewidth printhead 105, so that if a particular pagewidth printhead 105 needed to be replaced, the controller 14 would have access to the calibration data for the new printhead. In addition, if the characteristics of the temperature sensors drift over time the factory calibration can lose accuracy.

European Patent No. 0 622 209 discloses a carriage printer where a thermistor mounted on the carriage is used to calibrate a printhead substrate temperature sensor that is fabricated on the substrate of the drop ejector array module. It is disclosed that the printhead temperature sensor can be calibrated once at power-on or continuously. A drawback of the disclosed calibration method is that it does not ensure that the drop ejector array module is in a state of thermal equilibrium with the reference temperature sensor. For example, many inkjet printers have maintenance routines that dissipate energy on the drop ejector array module during long periods of printer inactivity. As long as the printer is plugged into an active electrical outlet, maintenance operations such as firing non-printing drops of ink from the nozzles into a reservoir are routinely done on a periodic basis, even if the printer is turned off or is in a sleep mode. When the user starts a print job and turns the power on or exits the sleep mode, he has no information about when maintenance spitting of ink drops has last occurred.

Because a printing system is in a less predictable environment than a factory environment, it must be established that the drop ejector array module 110 is in a state of thermal equilibrium with the reference temperature sensor 150. In one embodiment successive electrical signals from the primary temperature sensor 156 are sent to the controller 14. A signal sent from the primary temperature sensor 156 at an initial time is compared with a later signal that is sent after a predetermined delay time. The predetermined delay time can be between one second and one minute for example. The controller 14 determines whether the successive electrical signals differ from each other by less than a predetermined threshold value that is stored in printer memory. If the successive electrical signals differ by less than the predetermined threshold value, the controller 14 determines that the temperature of the drop ejector array module 110 is not appreciably changing as a function of time. Since other parts of the printing system tend to change temperature only very slowly (for example as the ambient temperature of the room changes), in some embodiments establishing that the temperature of the drop ejector array module 110 is not changing appreciably is sufficient for the controller 14 to determine that the drop ejector array module 110 is in a state of equilibrium with the reference temperature sensor 150. In other embodiments, the controller 14 similarly compares successive signals from the reference temperature sensor 150 to verify that its temperature measurement is also not changing appreciably as a function of time.

In another embodiment the controller 14 determines that the drop ejector array module 110 is in a state of thermal equilibrium with the reference temperature sensor 150 by monitoring how long it has been since any drop ejector 125 on the drop ejector array module 110 has been fired, whether for printing or for maintenance operations. A clock 11 on controller 14 for example is used to track time. In this embodiment a firing incidence time that corresponds to a most recent firing of any drop ejector 125 on drop ejector array module 110 is stored in memory, for example in memory 19 on controller 14. Controller 14 measures a time interval between a current time and the firing incidence time. Controller 14 compares the measured time interval to a predetermined threshold time interval that is stored in memory 19. If the time interval between the current time and the firing incidence time is greater than the predetermined threshold time interval, then the controller determines that the drop ejector array module 110 is in a state of thermal equilibrium with the reference temperature sensor 150.

Once the controller 14 has determined that the drop ejector array module 110 is in a state of thermal equilibrium with the reference temperature sensor 150 the calibration process can proceed. At a first time the controller 14 receives a first electrical signal from the primary temperature sensor 156. Substantially simultaneously at the first time, for example within one second and preferably within 0.1 second, controller 14 receives a corresponding first reference temperature reading from the reference temperature sensor 150 and associates the first reference temperature reading with the first electrical signal. Controller 14 calculates a temperature calibration coefficient using the first temperature reading and the first electrical signal, and stores the temperature calibration coefficient in memory such as memory 19.

Figure 8:
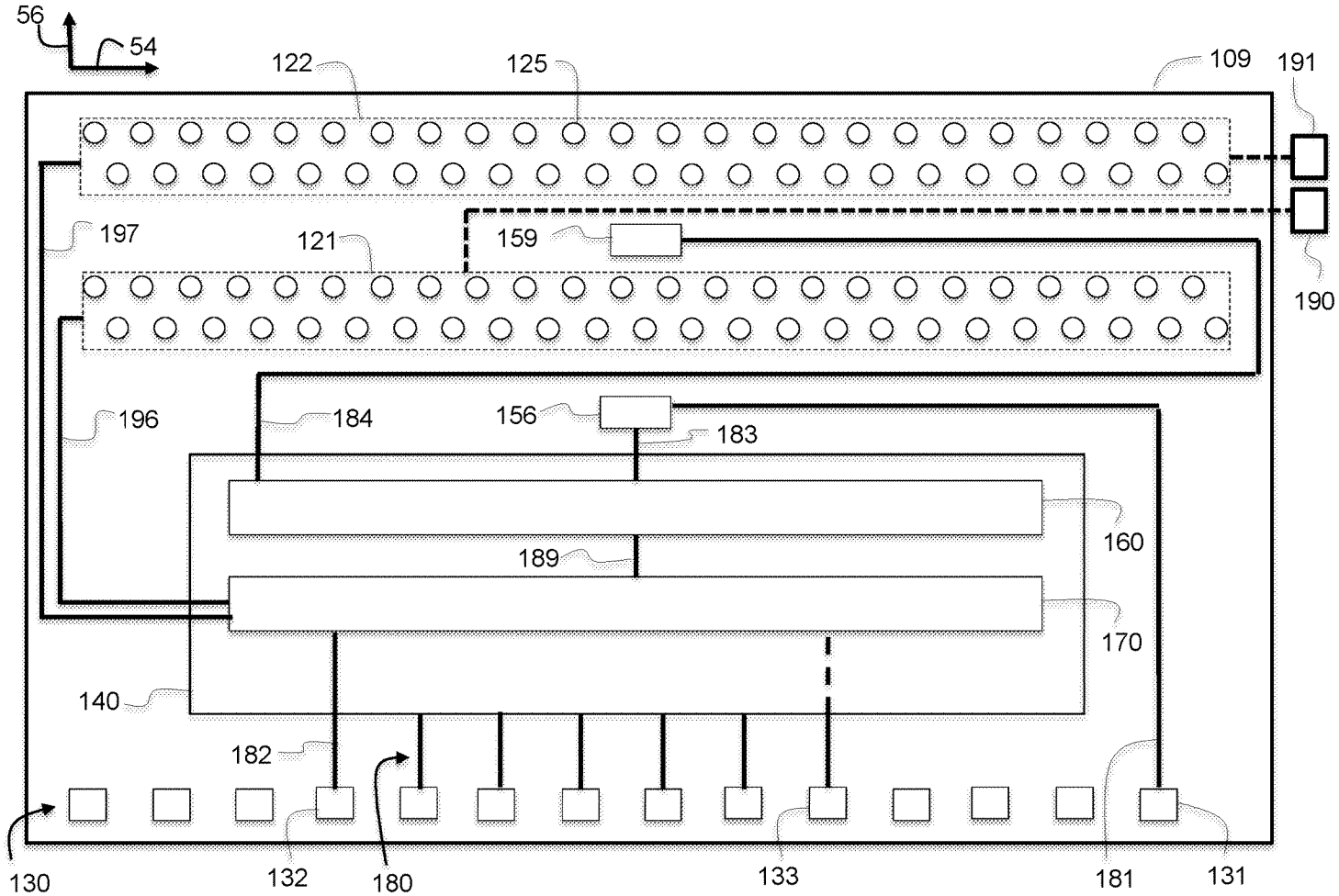
FIG. 8 is a top view of a drop ejector array module according to another embodiment.

In the embodiments described above with reference to FIG. 5 the primary temperature sensor 156 is located near a first set 126 of drop ejectors 125 in drop ejector array 120, and secondary temperature sensors 157 and 158 are located near a second set 127 and a third set 158 respectively of drop ejectors 125 in the same drop ejector array 120. The three temperature sensors 156, 157 and 158 are separated from each other along the array direction 54. FIG. 8 shows another embodiment having a drop ejector array module 109 with a first drop ejector array 121 that is fluidically connected to a first ink source 190 and a second drop ejector array 122 that is fluidically connected to a second ink source 191. For example, first ink source 190 can be a first color ink and second ink source 191 can be a second color ink. The fluidic connections from first ink source 190 and second ink source 191 typically are made on the bottom side 113 of the substrate 111 (FIG. 4) and are shown in FIG. 8 as heavy dashed lines. A primary temperature sensor 156 is centrally located near first drop ejector array 121, and secondary temperature sensor 159 is centrally located near second drop ejector array 122 and offset from the primary temperature sensor 156 along the scan direction 56. In the terminology used above, first drop ejector array 121 is the first set 126 and second drop ejector array 122 is the second set of drop ejectors 125 in this embodiment. Similar to the embodiment described above with reference to FIG. 5, primary temperature sensor 156 is connected to temperature comparison circuitry 160 by connection 183. Secondary temperature sensor 159 is connected to temperature comparison circuitry 160 by connection 184. Pulse modification circuitry 170 is connected to first drop ejector array 121 via connection 196 and to second drop ejector array 122 via connection 197. Other components, leads, connections and operations are similar to that described above with reference to FIGS. 5 and 6A-6F for drop ejector array module 110.

The invention has been described in detail with particular reference to certain preferred embodiments thereof, but it will be understood that variations and modifications can be effected within the spirit and scope of the invention.

PARTS LIST

1 substrate
2*a* temperature sensor
2*b* temperature sensor
3 array of drop ejection heaters
8*a* warming heater
8*b* warming heater
10 base plate
22 clock
12 image data source
13 image processing unit
14 controller
15 electrical pulse source
16 transport mechanism
17 transport control unit
18 ejection control unit
19 memory
20 partition wall
22 pressure chamber
24 ink inlet
30 nozzle plate
32 nozzle
35 heater (actuator)
50 printhead
52 printhead output line
54 array direction
56 scan direction
60 recording media
70 maintenance station
100 inkjet printing system
102 inkjet printing system
104 interconnects
105 pagewidth printhead
106 mounting substrate
107 interconnection board
108 printhead cable
109 drop ejector array module
110 drop ejector array module
111 substrate
112 top side
113 bottom side
115 ink feed
120 drop ejector array
121 first drop ejector array
122 second drop ejector array
125 drop ejector
126 first set
127 second set
128 third set
130 group (of input/output pads)
131 temperature output pad
132 pulse waveform input pad
133 clock input pad
140 logic circuitry
150 reference temperature sensor
151 temperature sensor
152 temperature sensor
153 temperature sensor
156 primary temperature sensor
157 secondary temperature sensor
158 secondary temperature sensor
159 secondary temperature sensor
160 temperature comparison circuitry

170 pulse modification circuitry
180 leads (to logic circuitry)
181 lead (to primary temperature sensor)
182 lead (to pulse modification circuitry)
183 connection (to primary temperature sensor)
184 connection (to secondary temperature sensor)
185 connection (to secondary temperature sensor)
186 connection (to first set)
187 connection (to second set)
188 connection (to third set)
189 connection (to pulse modification circuitry)
190 first ink source
191 second ink source
196 connection (to first drop ejector array)
197 connection (to second drop ejector array)
201 pulse waveform
202 pulse waveform
203 pulse waveform
204 pulse waveform
205 pulse waveform
206 pulse waveform
211 precursor pulse
212 precursor pulse
213 precursor pulse
221 precursor pulse
222 precursor pulse
223 precursor pulse
231 precursor pulse
232 precursor pulse
233 precursor pulse
241 precursor pulse
242 precursor pulse
243 precursor pulse
251 precursor pulse
252 precursor pulse
261 precursor pulse
$t_i$ idle time
T temperature
$W_f$ firing pulse width
$W_p$ precursor pulse width

The invention claimed is:

1. An inkjet printing system comprising:

at least one drop ejector array module, each drop ejector array module including:

a substrate;

an array of drop ejectors disposed on the substrate, each drop ejector including:

a nozzle;

an ink inlet;

a pressure chamber in fluidic communication with the nozzle and the ink inlet; and an actuator configured to selectively pressurize the pressure chamber for ejecting ink through the nozzle;

a primary temperature sensor disposed on the substrate in a first location proximate to a first set of drop ejectors;

at least one secondary temperature sensor disposed on the substrate in a second location proximate to a second set of drop ejectors;

temperature comparison circuitry disposed on the substrate, wherein the temperature comparison circuitry is configured to compare signals from the primary temperature sensor and the at least one secondary temperature sensor;

pulse modification circuitry disposed on the substrate, wherein the pulse modification circuitry is electrically connected to the temperature comparison circuitry and is configured to modify an input pulse waveform;

a temperature output pad connected to the primary temperature sensor; and a pulse waveform input pad connected to the pulse modification circuitry; and a controller that is electrically connected to the primary temperature sensor via the temperature output pad and to the pulse modification circuitry via the pulse waveform input pad.

2. The inkjet printing system of claim 1, wherein the primary temperature sensor is nominally the same as the at least one secondary temperature sensor.

3. The inkjet printing system of claim 2, wherein the primary temperature sensor includes a primary temperature controlled oscillator, and wherein each of the at least one secondary temperature sensors includes a corresponding secondary temperature controlled oscillator.

4. The inkjet printing system of claim 3, wherein the temperature comparison circuitry is configured to compare a frequency from the primary temperature controlled oscillator of the primary temperature sensor with a frequency from the secondary temperature controlled oscillator of the at least one secondary temperature sensor.

5. The inkjet printing system of claim 2, wherein the primary temperature sensor includes a primary thermistor, and wherein each of the at least one secondary temperature sensors includes a corresponding secondary thermistor.

6. The inkjet printing system of claim 5, wherein the temperature comparison circuitry is configured to compare a resistance of the primary thermistor with a resistance of the at least one secondary thermistor.

7. The inkjet printing system of claim 1, the at least one drop ejector array module further including a clock input pad, wherein the pulse modification circuitry is connected to the clock input pad.

8. The inkjet printing system of claim 1, the at least one drop ejector array module further including:

a first set of driver transistors that are connected to the first set of drop ejectors; and a second set of driver transistors that are connected to the second set of drop ejectors, wherein the pulse modification circuitry is connected to both the first set of driver transistors and the second set of driver transistors.

9. The inkjet printing system of claim 1, wherein the actuator of each drop ejector includes a resistive heater.

10. The inkjet printing system of claim 1 further comprising a reference temperature sensor that is separate from the at least one drop ejector array module, wherein the controller is electrically connected to the reference temperature sensor and to the temperature output pad of the at least one drop ejector array module, and wherein the controller is configured to calibrate the primary temperature sensor on the at least one drop ejector array module.

11. A method of controlling actuation of drop ejectors disposed at different locations on a drop ejector array module having a primary temperature sensor in a first location proximate to a first set of drop ejectors and a secondary temperature sensor in a second location proximate to a second set of drop ejectors, the method comprising:

performing a first temperature measurement with the primary temperature sensor and outputting the temperature with a temperature output pad;

performing a second temperature measurement with the secondary temperature sensor;

determining a temperature difference between the first temperature measurement and the second temperature measurement using temperature comparison circuitry disposed on the drop ejector array module;

receiving by a controller the first temperature measurement;

determining by the controller electrical pulse waveforms corresponding to the first temperature measurement;

sending electrical pulse waveforms corresponding to the first temperature measurement to the drop ejector array module;

using the electrical pulse waveforms to provide first actuation pulse waveforms to the first set of drop ejectors corresponding to the first temperature measurement;

using pulse modification circuitry disposed on the drop ejector array module to modify the first actuation pulse waveforms based on the temperature difference measured by the comparison circuitry and provide second actuation pulse waveforms to the second set of drop ejectors;

wherein the pulse modification circuitry is electrically connected to the temperature comparison circuitry and modifies an input pulse waveform received by a pulse waveform input pad connected to the pulse modification circuitry; and wherein the controller is electrically connected to the primary temperature sensor via the temperature output pad and to the pulse modification circuitry via the pulse waveform input pad.

12. The method of claim 11, wherein determining the temperature difference between the first temperature measurement and the second temperature measurement includes using the temperature comparison circuitry to measure a frequency difference.

13. The method of claim 11, wherein determining the temperature difference between the first temperature measurement and the second temperature measurement includes using the temperature comparison circuitry to measure a resistance difference.

14. The method of claim 11, wherein using pulse modification circuitry disposed on the drop ejector array module to modify the first actuation pulse waveforms includes at least one of changing a pulse width, changing a pulse amplitude, changing a number of pulses and changing an interval between pulses.

15. The method of claim 11, wherein using pulse modification circuitry disposed on the drop ejector array module to modify the first actuation pulse waveforms based on the temperature difference measured by the comparison circuitry and provide second actuation pulse waveforms to the second set of drop ejectors includes providing second actuation pulse waveforms that correspond to a temperature that is between the first temperature measurement and the second temperature measurement.

16. The method of claim 11, wherein using the electrical pulse waveforms to provide first actuation pulse waveforms to the first set of drop ejectors corresponding to the first temperature measurement includes using the pulse modification circuitry disposed on the drop ejector array module to modify the first actuation pulse waveforms based on the temperature difference measured by the comparison circuitry and provide the modified actuation pulse waveforms to the first set of drop ejectors.

17. The method of claim 16, wherein using pulse modification circuitry disposed on the drop ejector array module to modify the first actuation pulse waveforms to provide modified actuation pulse waveforms to the first set of drop ejectors includes at least one of changing a pulse width, changing a pulse amplitude, changing a number of pulses and changing an interval between pulses.

18. The method of claim 11 further comprising calibrating the primary temperature sensor using a reference temperature sensor that is separate from the drop ejector array module, the method comprising:

using the controller to determine that the drop ejector array module is in a state of thermal equilibrium with the reference temperature sensor;

receiving by the controller a first electrical signal from the primary temperature sensor at a first time;

receiving by the controller a corresponding first reference temperature reading from the reference temperature sensor substantially simultaneously at the first time;

associating the first reference temperature reading with the first electrical signal; and calculating a temperature calibration coefficient using the first reference temperature reading and the first electrical signal, and storing the temperature calibration coefficient in memory in the inkjet printing system.

19. The method of claim 18, wherein using the controller to determine that the drop ejector array module is in a state of thermal equilibrium with the reference temperature sensor includes:

comparing successive electrical signals received from the primary temperature sensor at an initial time and after a predetermined delay time; and determining that the successive electrical signals differ from each other by less than a predetermined threshold value.

20. The method of claim 18, wherein using the controller to determine that the drop ejector array module is in a state of thermal equilibrium with the reference temperature sensor includes:

storing a firing incidence time corresponding to a most recent firing of any drop ejector on the inkjet drop ejector array module;

measuring a time interval between a current time and the firing incidence time; and determining that the time interval is greater than a predetermined threshold time interval.

* * * * *